US008330068B2

(12) United States Patent
Amblard et al.

(10) Patent No.: US 8,330,068 B2
(45) Date of Patent: Dec. 11, 2012

(54) ELECTRICAL SWITCHGEAR UNIT COMPRISING A COMPLEMENTARY ELECTRICAL FUNCTION

(75) Inventors: Jean-Yves Amblard, Le Gua (FR); Noël Le-Corre, Saint Hilaire du Touvet (FR); Luc Moreau, Saint Martin le Vinoux (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 287 days.

(21) Appl. No.: 12/602,704

(22) PCT Filed: Jun. 12, 2008

(86) PCT No.: PCT/FR2008/000804

§ 371 (c)(1), (2), (4) Date: Dec. 2, 2009

(87) PCT Pub. No.: WO2009/007542

PCT Pub. Date: Jan. 15, 2009

(65) Prior Publication Data

US 2010/0176091 A1 Jul. 15, 2010

(30) Foreign Application Priority Data

Jun. 29, 2007 (FR) ..... 07 04685

(51) Int. Cl.
*H01H 33/02* (2006.01)

(52) U.S. Cl. ..... 218/149; 218/35; 218/156

(58) Field of Classification Search ..... 218/15, 218/22–28, 34–38, 149–152, 155–158; 335/16, 335/147, 195, 201, 202
See application file for complete search history.

(56) References Cited

U.S. PATENT DOCUMENTS 6,414,256 B1 * 7/2002 Chen et al. ..... 335/201
6,480,082 B1 * 11/2002 Aihara et al. ..... 335/202

FOREIGN PATENT DOCUMENTS

| | | |
|---|---|---|
| EP | 0 325 071 | 7/1989 |
| EP | 0 948 021 | 10/1999 |
| WO | WO98/42001 | 9/1998 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

The present invention relates to an electrical switchgear unit designed to be fixed onto a fixing support and comprising at least one electrical switching module and at least one module housing a complementary electrical function, at least one of the complementary modules being situated next to at least one of the above-mentioned switching modules, the or each switching module comprising an arc extinguishing chamber. This unit is characterized in that the arc extinguishing chamber of the module situated facing the complementary module presents a cambered face towards the inside of said arc extinguishing chamber so as to create a space E,F inside said chamber enabling a part of the volume of the complementary module to be housed, and in that the ends of said arc extinguishing chamber encroach on the volume of the complementary module.

7 Claims, 2 Drawing Sheets

ELECTRICAL SWITCHGEAR UNIT COMPRISING A COMPLEMENTARY ELECTRICAL FUNCTION

Figure 1:
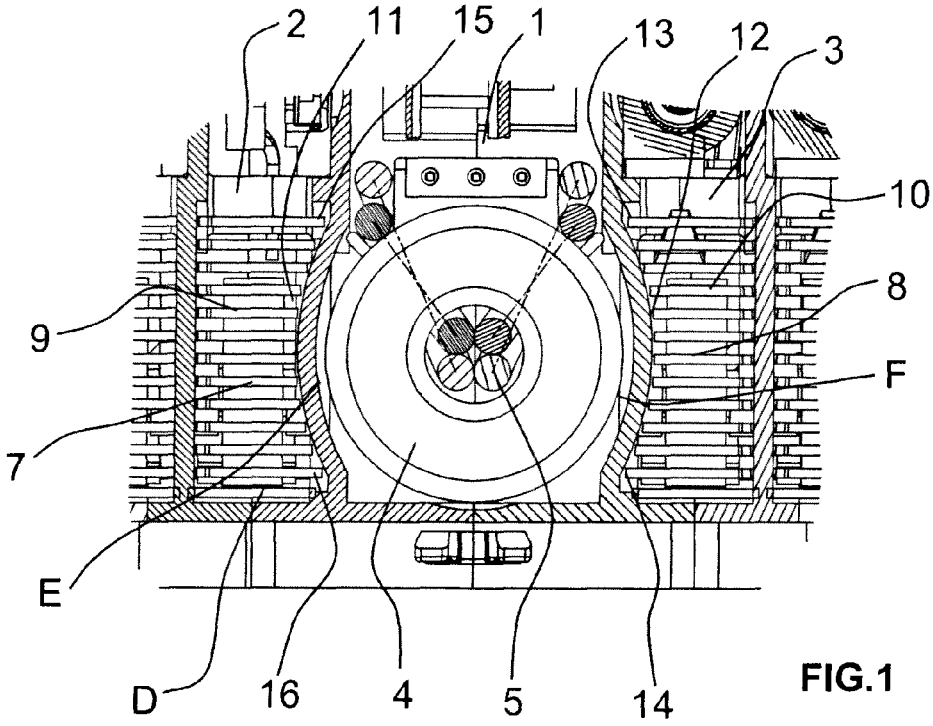

This application is a national stage entry of International Application No. PCT/FR2008/000804, filed Jun. 12, 2008 designating the U.S., which claims the benefit of French Application No. 07/04685, filed Jun. 29, 2007.

The present invention relates to an electrical switchgear unit designed to be fixed onto a fixing support and comprising at least one switching module and at least one module housing a complementary electrical function, at least one of the modules housing a complementary electrical function being situated next to at least one of the above-mentioned switching modules, the or each switching module comprising an arc extinguishing chamber.

The document EP 0948021 is known describing a multipole differential circuit breaker housed in a single case, a differential protection module surrounded on each side by two electrical switching modules each housing a circuit breaker pole-unit, the assembly being contained in dimensions corresponding to four basic modules. In this document, the switching compartments are of uniform width over their whole height. These uniform widths of the switching compartments prevent the size of the toroid from being able to be increased. This results in it not being possible to increase the performances of the unit without increasing the width of the unit.

The present invention overcomes these problems and proposes an electrical switchgear unit comprising a certain number of switching modules and at least one module performing a complementary electrical function, wherein either the rated current or the performances of the complementary function are increased while at the same time preserving the switching performances of the unit and without increasing the overall width of the unit.

For this purpose, the object of the present invention is to provide an electrical switchgear unit of the above-mentioned kind, this unit being characterized in that the arc extinguishing chamber of the module located facing the complementary module presents a cambered face towards the inside of said arc extinguishing chamber so as to create a space inside said arc extinguishing chamber enabling a part of the volume of the module housing the complementary function to be housed, and in that the ends of said arc extinguishing chamber encroach on the volume of the complementary module.

According to another feature, the or each of the arc extinguishing chambers comprises a stack of plates extending in a substantially parallel direction to one another, the edges of the plates of the above-mentioned arc extinguishing chamber, situated facing the complementary module, being situated in a plane cambered towards the inside of the corresponding arc extinguishing chamber.

According to another feature, the switching module(s) respectively house(s) the pole-unit(s) of a circuit breaker and the module housing the complementary function is a differential protection module.

According to a particular embodiment, the differential protection module comprises a toroid and the toroid is partially housed in the volume of the adjacent switching module(s).

According to another particular feature, this unit comprises a differential module surrounded on each side by a switching module housing a circuit breaker pole-unit, the two faces of the arc extinguishing chambers of the two switching modules situated on each side of the differential module having a shape that is cambered towards the inside of said arc extinguishing chamber.

According to another feature, the or each switching module comprising an electromagnetic coil, this unit is characterized in that the or each switching module comprises at least one wall comprising an offset so as to form two portions of modules of different widths, the width being the dimension of the unit measured parallel to the direction of alignment of the modules, the part of module presenting the smaller width housing the arc extinguishing chamber and the part of module presenting the larger width housing the coil, said coil presenting a larger diameter than the width of the corresponding arc extinguishing chamber.

According to another feature, the differential protection module comprises a toroid placed between two arc extinguishing chambers facing one another, and the axis of the toroid extends in a parallel direction to the axis of the coil(s).

Figure 2:
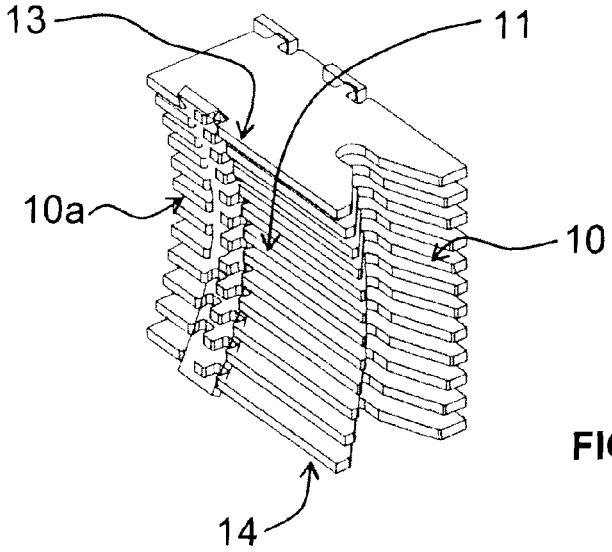
Figure 3:
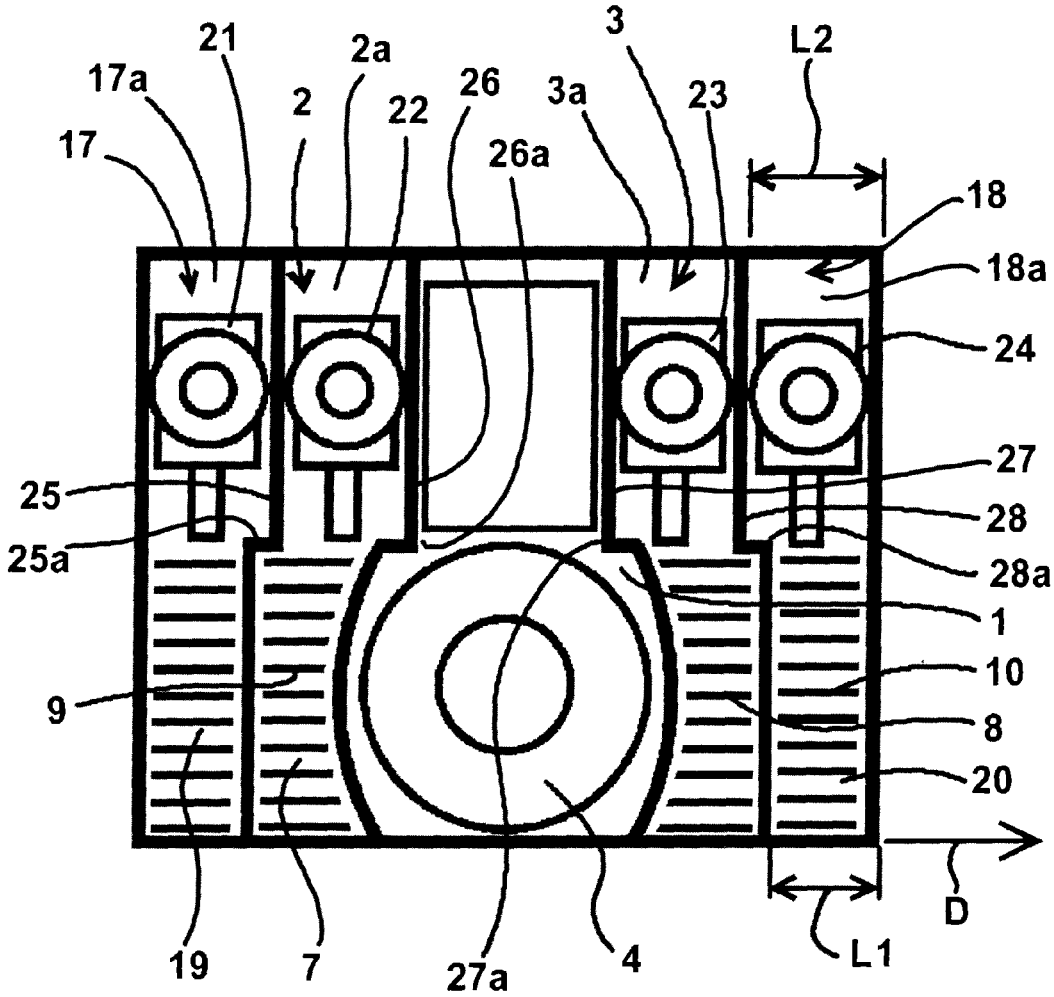

But other advantages and features of the invention will become more clearly apparent from the following detailed description which refers to the accompanying drawings given for example purposes only and in which:

FIG. 1 is a partial cross-sectional view of a two-pole differential circuit breaker according to the invention along a plane parallel to the base of the apparatus, FIG. 2 is a perspective view illustrating a set of plates constituting an arc extinguishing chamber according to the invention, and FIG. 3 is a schematic representation in plan view illustrating a multipole differential circuit breaker according to the invention according to a particular embodiment of the invention.

The inner part of a two-pole differential circuit breaker D comprising a differential module 1 surrounded by two switching modules 2,3 has been represented in FIG. 1. In a manner known as such, differential module 1 comprises a toroid 4 through which main conductors 5 pass, and the switching modules 2,3 each comprise an arc extinguishing chamber 7,8, each arc extinguishing chamber 7,8 comprising a set of juxtaposed plates 9,10 extending in a direction substantially parallel to one another and to the base of the unit.

According to the invention, faces 11,12 of arc extinguishing chambers 7,8 located facing the toroid are cambered towards the inside of the adjacent arc extinguishing chambers. For this purpose, the width of the plates is smaller in the centre of arc extinguishing chambers 7,8 and increases as the distance to the ends 13,14,15,16 of said chambers decreases. Edges 10*a* of the plates located facing the complementary module define an imaginary three-demensional surface cambered towards the inside of the corresponding adjacent arc extinguishing chamber. This has enabled a space E,F to be created inside arc extinguishing chambers 7,8 to house a part of toroid 4, the dimensions of the latter having thereby been able to be increased. The reduction of the width of the plates in the central part of arc extinguishing chambers 7,8 is compensated by the increased width of the plates at ends 13 to 16 of chambers 7,8, thereby resulting in the electrical breaking performances not being modified.

The invention has thereby enabled an arc extinguishing chamber to be achieved enabling the toroid to encroach on the volume of the switching pole-units without penalising the breaking capacity, on the one hand by means of creation of an additional space to house the toroid the dimensions whereof have been increased, and on the other hand due to the increase of the width of the extinguishing chamber at the ends of said chamber. The toroid is surrounded by material of the chamber, the quantity of material being preserved so as to preserve the breaking capacity, this being achieved without increasing the width of the unit.

In FIG. 3, a multipole differential circuit breaker according to the invention comprises a differential protection module 1 surrounded on each side by two switching modules 2,3,17,18. Each switching module 2,3,17,18 comprises an arc extinguishing chamber 7,8,19,20 housing plates 9,10 arranged parallel to one another and an electromagnetic coil 22,23,21,24. Each part 2*a*,3*a*,17*a*,18*a* of switching module 2,3,17,18 housing coil 21 to 24 is offset with respect to its corresponding arc extinguishing chamber 7,8,19,20 so that each switching module 2,3,17,18 extends into the adjacent switching module or the complementary module over a length substantially corresponding to that of the electro-magnetic coil. For this purpose, separating partitions 26,27,25,28 of switching modules 2,3,17,18 present an offset 26*a*,25*a*,28*a*,27*a* in the direction of complementary module 1, at the level of the separation between the arc extinguishing chamber and the coil housing, to form two portions of modules of different widths L1,L2, this width being measured parallel to the direction of alignment D of the modules. The part of module having the smaller width L1 houses the arc extinguishing chamber, and the part of module having the larger width L2 houses the coil, said coil having a larger diameter than the width of its corresponding arc extinguishing chamber. This arrangement enables the cross-sections of the coil wires to be increased to reduce overheating by 20%.

This means that a wire of suitable cross-section for the targeted performances can be used and that the width of the unit is not increased. The performances of the magnetic protection devices are thereby increased while at the same time preserving the initial dimensions of the unit.

This arrangement is particularly advantageous in the case where the toroid is placed in such a way that its axis is parallel to the axis of the coils. This particular arrangement of the toroid does in fact enable the partitions to be offset so as to enlarge the space in which the coils are housed.

The invention applies advantageously to differential circuit breakers and in general manner to monoblock modular electrical switchgear units comprising a central or lateral complementary function such as an integrated remote control, an outlet gas recirculation system etc.

The invention is naturally not limited to the embodiments described and illustrated which have been given for example purposes only.

On the contrary, the invention extends to encompass all the technical equivalents of the means described as well as combinations thereof if the latter are achieved according to the spirit of the invention.

The invention claimed is:

1. An electrical switchgear unit designed to be fixed onto a fixing support, said unit comprising:

at least one switching module, and at least one complementary module housing a complementary electrical function, said at least one complementary module located next to said switching module, the switching module comprising an arc extinguishing chamber, the arc extinguishing chamber of said at least one switching module facing said at least one complementary module having a three-dimensional surface cambered towards the inside of said arc extinguishing chamber thereby defining a space inside said arc extinguishing chamber, said space housing the complementary module, and the ends of said arc extinguishing chamber extend into the volume of its complementary module, the extinguishing chamber having a plurality of plates therein, each of said plates having an edge (10*a*) facing the complementary module, said edges defining an imaginary three-dimensional surface cambered toward the inside of the arc extinguishing chamber, the width of said plates increasing as they increase in distance from the center of the arc extinguishing chamber toward the ends of said chamber.

2. The electrical switchgear unit according to claim 1, wherein the arc extinguishing chamber comprises a stack of plates each extending substantially parallel to one another, and the edges of the plates are facing the complementary module, and are situated in an imaginary three-dimensional surface cambered towards the inside of the arc extinguishing chamber.

3. The electrical switchgear unit according to claim 1, wherein the switching module houses pole-units of a circuit breaker, and the complementary module is a differential protection module.

4. The electrical switchgear unit according to claim 3, wherein the differential protection module comprises a toroid, and the toroid is partially housed in the volume of the adjacent switching module.

5. The electrical switchgear unit according to claim 1, which comprises a differential module surrounded on two sides by a switching module, each housing a circuit breaker pole-unit, the two faces of the two arc extinguishing chambers being on opposite sides of the differential module and each having a shape that is cambered towards the inside of the adjacent arc extinguishing chamber.

6. The electrical switchgear unit according to claim 1, and comprising a plurality of switching modules, each switching module comprising an electromagnetic coil, and having at least one wall comprising an offset defining two portions, each portion of each module having different widths, the width being measured parallel to a direction of alignment of the modules, the part of each module having the smaller width housing an arc extinguishing chamber, and the part of each module having the larger width housing a coil, said coil having a larger diameter than the width of its corresponding arc extinguishing chamber.

7. The electrical switchgear unit according to claim 6, wherein the differential protection module comprises a toroid located between two facing arc extinguishing chambers, and the axis of the toroid extends in a direction parallel to the axes of the coils.

* * * * *